United States Patent [19]

Critelli

[11] Patent Number: 4,527,796

[45] Date of Patent: Jul. 9, 1985

[54] METHOD OF FILLING AN ATHLETIC BAG WITH AIR AND LIQUID

[76] Inventor: Thomas P. Critelli, 4920 Millersport Hwy., East Amherst, N.Y. 14051

[21] Appl. No.: 192,359

[22] Filed: Sep. 30, 1980

[51] Int. Cl.[3] ..... A63B 67/00

[52] U.S. Cl. ..... 272/77; 273/55 A

[58] Field of Search ..... 273/55 R, 55 A, 26 R; 272/76, 77, 78

[56] References Cited

U.S. PATENT DOCUMENTS

| | | | |
|---|---|---|---|
| 327,403 | 9/1885 | McDonnell | 272/77 |
| 694,335 | 2/1902 | Thenan et al. | 273/76 |
| 1,250,095 | 12/1917 | Liljegran | 273/76 |
| 2,203,259 | 6/1940 | Gilman | 273/55 A |
| 2,334,360 | 11/1943 | St. John | 272/77 |
| 2,449,935 | 9/1948 | Gilman | 273/55 R |
| 2,826,416 | 3/1958 | Heffner | 272/78 |
| 2,987,317 | 6/1961 | Acevedo | 272/77 |
| 3,234,685 | 2/1966 | Harrowe | 272/78 |
| 3,337,217 | 8/1967 | Cunmins | 273/55 A |
| 3,384,372 | 5/1968 | Dickens | 273/55 A |
| 3,450,407 | 6/1969 | Russo | 273/55 R |
| 3,933,354 | 1/1976 | Goldfarb et al. | 272/76 |
| 4,103,889 | 8/1978 | Luber | 273/55 A |
| 4,108,428 | 8/1978 | Winterbottom | 272/76 |
| 4,185,821 | 1/1980 | Piccini | 273/26 R |
| 4,345,755 | 8/1982 | Eidson | 272/78 |

FOREIGN PATENT DOCUMENTS

| | | | |
|---|---|---|---|
| 454669 | 12/1928 | Fed. Rep. of Germany | 272/77 |
| 432056 | 2/1935 | United Kingdom | 272/77 |

*Primary Examiner*—Richard C. Pinkham
*Assistant Examiner*—T. Brown
*Attorney, Agent, or Firm*—Raymond F. Kramer

[57] ABSTRACT

A method of filling an athletic bag with water and air. After the bag has been assembled and provided with a push-pull valve which communicates with the interior of the bag, water and air are caused to pass through the valve until the bag reaches a predetermined firmness and pressure; then the valve is closed. The firmness of the bag can be controlled by varying the air pressure therein through the push-pull valve. The water and air are confined in a bladder which, before being filled, is essentially the same size and shape as the cover of the bag.

4 Claims, 4 Drawing Figures

METHOD OF FILLING AN ATHLETIC BAG WITH AIR AND LIQUID

This invention relates to an athletic bag of controllable blow responsive characteristics. More particularly, it relates to such a bag which is primarily useful for the training of boxers and martial arts practitioners, and which includes a container of liquid, pressurized by a gas, with the gas pressure being controllable to vary the blow responsive characteristics of the bag.

Punching bags or striking bags have long been employed by boxers and in recent years they have also been used by practitioners of the martial arts, such as karate. They allow an athlete to simulate a contest against a human opponent and make it possible for him simultaneously to check his reflexes, accuracy and power. They also help to strengthen him and improve his muscular development. Although light punching bags have been employed and are considered very useful in aiding in the development of quick reflexes for boxers, such are virtually useless for training in the martial arts. Also, they do not simulate the type of reaction that is obtained when striking a human opponent, as in a boxing or karate match. For such reasons heavier bags have been employed, usually filled with sand and covered with padding. However, such bags have often left much to be desired because the padding has tended to lump or mat and the padding-sand combination does not accurately simulate the feel of a blow struck against a human body. Furthermore, once such bags are manufactured, their characteristics are essentially permanent, except for normal physical deterioration of the padding and sifting of the same. As a result of this fixed nature, they do not allow flexibility of training practices. The use of a combination of air and sand to give weight and adjustable impact absorbing characteristics to an athletic bag has been suggested previously but such suggested bag, with an outer bladder of air and an inner core of sand, does not possess the advantages of the bags of this invention.

In accordance with the present invention an athletic bag of controllable blow responsive characteristics, suitable, when filled with liquid and gas under pressure greater than atmospheric, for being struck by a part of the body of an athlete during practice and for controllably absorbing the force of such blow, comprises a container for holding fluid under pressure, an opening in said container and a valve communicating with such opening and selectively permitting or preventing movement of fluid through it, which container includes a flexible substantially non-elastomeric outer cover and an elastomeric or flexible fluid-tight inner bladder capable of holding liquid and gas under pressure so that upon substantially filling said inner bladder with liquid and raising the pressure in the bladder above atmospheric by addition of a gas through the valve, which is in communication with the opening in the container, after sealing of said valve the bladder, under such pressure, is restrained by the cover against expansion and exerts a controllable pressure on said cover, which is related to the bladder pressure, so that the blow responsive characteristics of the bag may be controlled. Also within the invention are such a bag at a specified gas pressure and containing a specified proportion of its volume as liquid, and a method of preparing such a bag, especially by addition of air under pressure by mouth through a suitable valve. Additionally, the invention includes, in some of its aspects, padding between the bag bladder and cover, indicating devices for counting blows and measuring the force and velocity of such blows, rotatable and relatively fixed bags, and specially constructed bags, useful for practicing uppercut type blows.

A search of the prior art U.S. patents, conducted in subclasses 73-379; 272-76; -77; -78; -134; -135; 273-26R and -55; and of the foreign patents and literature in the Examiners' search files for subclass 272-77 resulted in the finding of the following patents which may be considered as somewhat relevant in one or more aspects of the present invention: U.S. Pat. Nos. 124,588; 589,986; 740,160; 1,119,635; 2,197,545; 2,203,259; 2,549,197; 2,913,245; 3,111,317; 3,176,985; 3,220,729; 3,580,575; 4,093,217; 4,103,889; 4,108,428; 4,123,053; 4,185,821; and 4,208,048. Of these patents it is considered that the most relevant are U.S. Pat. Nos. 4,103,889 and 4,185,821. U.S. Pat. No. 4,103,889 is for an impact absorbing bag for use in physical conditioning and for teaching punching and kicking techniques, as in teaching karate. The bag described in the patent includes an internal core or vertical cylinder of sand surrounded by an air bladder in which the air pressure is controllable to modify the hardness of the bag and to maintain the sand in position. This patent does not utilize a liquid and the employment of liquid in the present invention, instead of air adjacent to the bag exterior, significantly improves the bag characteristics. The athletic bag of the present invention has characteristics more like that of a human body target and the amount of air needed to adjust the properties of the bag is much less. Furthermore, the use of sand, which is often hard to obtain, especially when a collapsed bag is being reassembled at a location away from the athlete's home base, is obviated. U.S. Pat. No. 4,208,048 relates to a batting practice device of generally vertically cylindrical shape filled with water but it is not pressurized with air and would not be useful as a punching bag or karate bag to the same extent as the bag of this invention because its blow responsive characteristics are not as readily controllable, and they are not controllable at all while the bag weight remains constant.

The invention will be readily understood by reference to this specification taken in conjunction with the drawing, in which.

Figure 3:
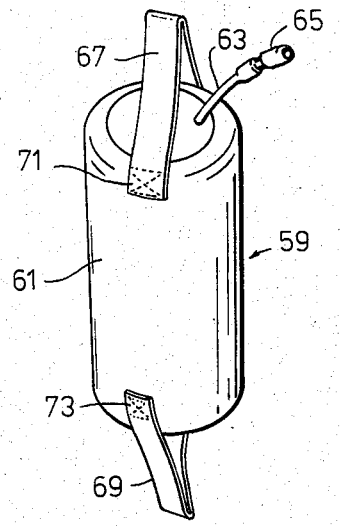
Figure 4:
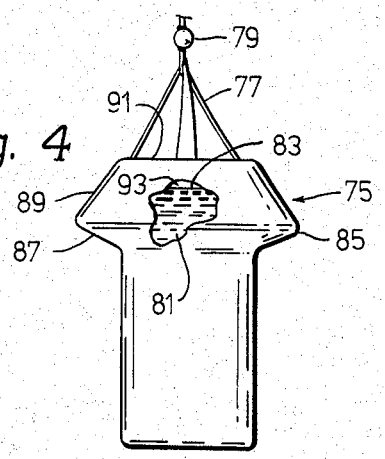

FIG. 3 is a perspective view, seen from the top, of a smaller bag of this invention with means at the top of the bag for suspending it from an overhead support and means at the bottom thereof for restraining the bag against rotational and translational movement, when struck; and FIG. 4 is a partially cutaway side elevational view of a special athletic bag of this invention, one for the practice of boxing uppercut punches and corresponding other martial arts blows, which is shown suspended from a support so that it can readily rotate, as in response to being struck off center.

Figure 1:
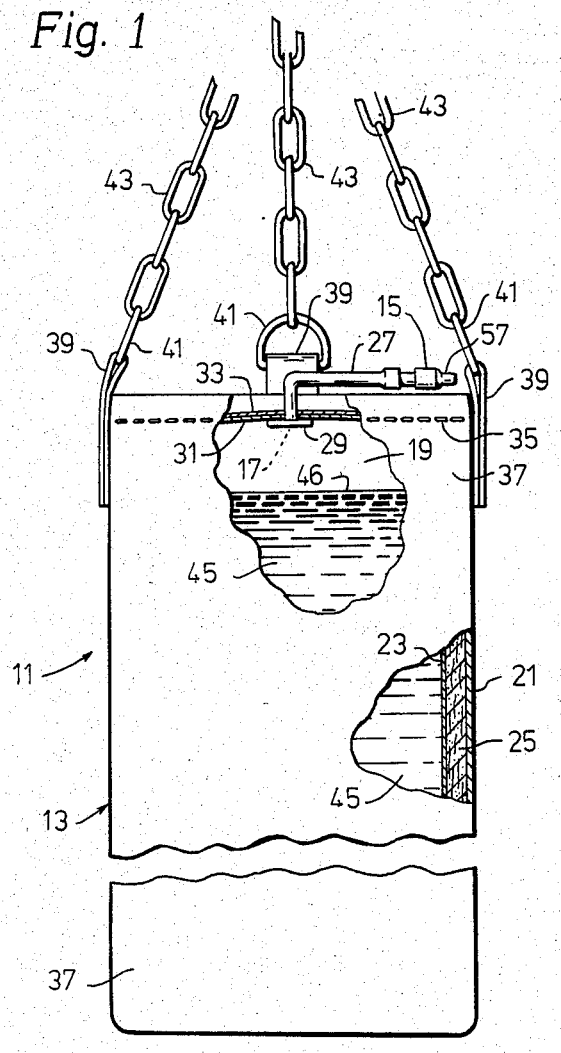
FIG. 1 is a partially cutaway front elevational view of a "heavy bag" of this invention, containing liquid and gas under pressure, and suspended, ready for use, from an overhead support (not shown)

In FIG. 1 athletic bag 11 includes a cylindrical container 13, a valve 15, and an opening 17 in the container, through which opening gas space 19, in the interior of the container, can be communicated with the atmosphere when the valve is opened and can be sealed off from the atmosphere, so as to be maintained under pressure, when the valve is closed. Container 13 includes an outer cover 21 over the side, top and bottom thereof and an inner bladder 23, of approximately the same dimensions as the cover and interiorly located with respect to it. Between them, as shown, is padding 25, which extends, preferably in cylindrical or sheet form, inside the circumference of the cylindrical container cover, but may also be present inside the cover at the bottom and top thereof, if desired. Bladder 23 may be made of a piece of film or sheet tubing, appropriately sealed together so unitary top and bottom portions are created, or may be made from flat sheet material, appropriately cut to size and heat sealed. While heat sealing is preferred, other methods of joining the bladder parts together, such as solvent sealing, cementing, taping, sewing and stapling, may be employed, when appropriate and when the result is a pressure-tight bladder (except for any desired sealable opening[s] therein). As shown, bent tube 27 has a flange 29 thereof sealed to a top part 31 of bladder 23 about the opening 17 and valve 15 is connected to tube 27 and sealed to it whereby the mouthpiece portion of the valve 15 includes a cylindrical extension 57 through which air or water may be added to the bladder or removed therefrom. Although in some instances friction fit connections, which have been found to be pressure tight at the pressures employed, are also feasible for the valve-tube connection. Also, the valve may be sealed directly to the bladder, without the intervening tube, and sometimes it may be desirable for the opening in the bladder to be at the side thereof, near the top, for more ready access. As is illustrated, the padding 25 is not present at the top of the container and the top part 33 of the cover is in contact with the bladder top 31. Stitching 35, through the side 37 of cover 21 holds cover 33 in place. The illustrated stitching does not penetrate the bladder, which, as shown, is expanded upwardly in the central portion of the top thereof due to the internal gas pressure being above atmospheric. Sewn or otherwise fastened to the bag cover are loop holding means 39 to which supporting chain links 41 are held and by which the bag is attached to chains 43 and through them to an overhead supporting member, not shown.

The described bag may be filled with water 45 to an appropriate level 46 (at least a certain major proportion of the bag volume should be filled with water or other liquid, as will be described later) and the gas space in the bag should be placed under a superatmospheric pressure, preferably by blowing air into it by mouth through valve 15, tube 27 and opening 17 so that the internal air pressure is in a certain desirable range, as will also be mentioned later.

Figure 2:
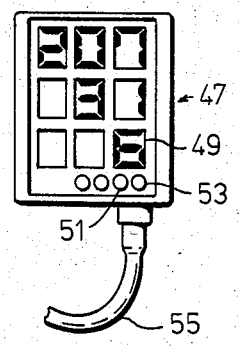
FIG. 2 is a front elevational view of an electronic indicator, responsive to fluid pressure, and part of a connecting hollow tube, which is connectable to a bag like that shown in FIG. 1 to record the number and characteristics of blows delivered to the bag.

In FIG. 2 there is shown an LED or liquid crystal type indicator for a microprocessor recording data with respect to number and characteristics of blows delivered to the athletic bag. Instrument 47 includes a plurality of digital readouts, as shown at 49, for example (for velocity), with selector buttons, as shown at 51, for example (for velocity) and an overall on-off switch 53. The instrument is connected by means of flexible tubing 55 to gas space 19 in bag 11 by any suitable means, for example, by press fitting tube 55 over cylindrical portion or extension 57 (see FIG. 1) of valve 15. However, the connecting tubing 55 or other equivalent means may be located elsewhere and in some instances may be more preferably communicating with the liquid, rather than the gas, in the bag. The electronic circuitry for registering blow characteristics is not shown because it is considered that this is known in the art and does not form a part of the present invention. Suffice it to say that in the illustration given the number of blows administered to the athletic bag may be 207, the pressure (or force) applied may be 31 and the velocity of the blow struck may be 6. While the 207 will usually be the exact number of blows struck, with respect to the other characteristics the numerals displayed may or not be direct readings of the pressure and velocity (or other properties) in standard units. Usually it will be easier to calibrate the instrument so that actual pressure or force and velocity can be determined, rather than to redesign the electronic circuitry.

FIG. 3 illustrates a small bag, normally being of a weight, when appropriately filled with water or other suitable liquid, in the range of about 4 to 10 kg., e.g., about 7 kg. However, the structures shown herein also are for bags of other sizes, such as those of intermediate weights, 15 to 25 kg. e.g., about 18 kg., and those of greater weights, 30 to 40 kg., e.g., about 36 kg. Bag 59, as shown, includes an outer cover 61 encasing an inner bladder, not shown, with connecting tube 63 connected with an opening, not shown, in the top of the bladder, and having a valve 65 sealed to it. Valve 65 may be of the type illustrated in FIG. 1 (described in more detail later) or may be any other suitable valve, such as a pin type or bicycle tire type valve, which latter valve will normally be in closed position except when the pin thereof is depressed and fluid is being forced through it. Such valve may be heat sealed or otherwise positively joined to tubing 63 or may be press fitted into it so that the valve may be removed when desired, still providing a pressure tight seal when installed. Bag 59 has straps 67 and 69 sewn to cover 61 thereof by stichings 71 and 73, respectively. In use, strap 67 is held at the top thereof to an overhead support and strap 69 is held to a fastening device attached to the floor. When such holding means, not illustrated, include swivels, the bag will be free to rotate but will have translational movement thereof restricted, whereas when the supports and holding devices are not movable rotational movement of the bag will also be restricted.

In FIG. 4 an uppercut type of punching bag 75 is shown, suspended by straps 77 thereof from a swivel means 79, which allows rotation of the bag in response to blows. The bag is of the same general construction as that of FIG. 1 (and FIG. 3) with the exception that the lower limit of the water level will normally be somewhat higher, with a greater volume percentage of water in the bag often being desirable to keep the level thereof above the "jaw" portion of the bag. As shown, water 81 has a surface thereof 83 appreciably higher than the level of the widest portion 85 of the bag. Such widest portion is created by the bag being shaped and constructed so as to extend upwardly and outwardly near the top of a cylindrical form thereof, along surface 87, after which it is rounded at 85 and extends upwardly and inwardly along surface 89 to the top 91 of the bag. Inside the bag air or gas space 93 is appropriately pressurized, as previously described.

Although the illustrations of the athletic bag given in the drawing are with respect to punching bags and martial arts bags and some mountings thereof have been shown and particular preferred sizes of such apparatuses have been given, it should be understood that various other sizes may be employed, the bags may be mounted differently, and they may be used for other athletic purposes. The significant advantages of the present structure, such as have previously have alluded to, and which will be mentioned in greater detail below, will often also be important in such other applications. However, primarily those advantages are of special significance with respect to the present bags when they are employed as punching bags or for karate or other martial arts practice.

The use of a liquid, such as water, in the present bags allows them to be desirably weighted very easily and with a readily available, normally "free", conveniently addable and easily disposable material. Thus, when as in many athletic endeavors, demonstrations and competitions, travel by the athlete from his home location to a distant site for a competition or demonstration makes the carrying of a fully weighted bag inconvenient, the present bags may be emptied of their weighting liquid and may be conveniently folded so as to be easily transportable. Upon arriving at his destination, it is a simple matter for the athlete to fill the bag to the desired height with a suitable liquid, water being most frequently used, and then to blow into the bag to pressurize it to a desired firmness, after which it is immediately ready for use. When water is employed as the filling liquid it may be added directly through the mouthpiece by having a tube connecting the mouthpiece and a faucet by means of friction fits and ordinary hose connections. During use of the bag, the firmness and blow absorbing properties of it may be readily adjustable by merely opening the valve and changing the mouth delivered air pressure in the bag. Thus, the invented athletic bag is really the equivalent of a plurality of such articles of different firmnesses. It can also have the weight thereof varied within limits by the use of more or less liquid, preferably within the ranges given. When the practice, contest or demonstration is over the bag may be readily disassembled and the filling liquid, especially if it is water, may easily be disposed of.

Convenience of assembly, ease of transportion, ready adjustability of properties, economics of production, long useful life and attractive appearance are all important and are characteristics of the present bags but one of the most important features of the bag is the more accurate simulation of a human opponent to the athlete using the bag. The liquid in the bag, which is in contact with the bladder, which extends to near the circumference of the bag, with only padding material (when employed) and cover material separating it from the blows of the athlete, gives the bag characteristics more like that of the human body than padded sand, air, felt or scrap textile filling material, all of which have been employed in the past. When a blow is struck against the present bag, the liquid yields or "gives", much in the manner of a human body, and like the human body, it similarly tends to return to original position. The "feel" of the bag, a characteristic to important to a boxer or karate expert, is far superior to that of conventional bags, which it is expected will soon be replaced by that of this invention. Because a fluid is being utilized the bag always returns to original shape; it does not mat, sift, or otherwise change so as to become unbalanced and uneven. As a result, the bag, if mounted on a swivel, will tend to rotate readily and regularly, without excessive wobble, when hit by an off center blow, thereb indicating to the athlete that his striking of the bag ha been inaccurate and requires improvement. In additio to its being important in practice to develop forceft blows and to strike with increasing velocity, anothe desirable practice technique is to strike and withdra quickly so as to be ready to strike again. The preser bag tends to push back a first or other body part strikin the bag and so indicates to the athlete, if he notes suc action, that he has not been withdrawing quickl enough after making contact. These advantages of th invented article are unique to it and are not obtainabl from prior art products known to applicant.

To obtain the desirable rotational properties men tioned above and to have a bag which presents a con stant appearing surface to the athlete using it, it is gener ally most desirable that the bag be of vertically cylindri cal shape or, as in the case of the uppercut bag or varia tions thereof, of a surface of revolution about a vertica axis, so as to maintain proper bag balance. However, i is also within the invention to apply the principle thereof to other types of bags, such as those whicl simulate human or other target shapes or which may b intentionally shaped irregularly to make them mor suitable for particular types of practices or demonstra tions.

Another important advantage of the invention is tha the liquid, being mobile, immediately conforms to th shape of the body part administering a blow and the moves away from the area of the bag struck by th athlete, thereby helping to distribute the force of th blow. This helps to prevent the non-elastomeric cove and the padding, when present, from being damaged On the contrary, when sand is used as a weighting mate rial, its lower mobility often causes greater wear on cover and any non-elastomeric inner liner that could b used, due to greater distorting or stretching forces bein applied. The cover wear preventing advantages of th invention are also obtainable, sometimes to a lesse extent, when padding is utilized.

Although the broad principles of this invention ma be applied to athletic bags wherein the liquid is othe than water and the gas is other than air, normally water such as ordinary tap water, will be the liquid of choice and air, as expelled by human lungs, will be the gas o choice. However, to obtain special properties othe gases and liquids can also be utilized. For example atmospheric air, compressed air, liquefied gases, such a lower hydrocarbons, e.g., isobutane, fluorinated lowe hydrocarbons, e.g., Freons ®, nitrogen, carbon dioxide argon and helium can be employed as the gases in suit able circumstances and sometimes for special effects. O these, the inert gases and carbon dioxide may help t maintain the bladder in more lively, resilient form, du to inhibition of oxidation thereof. Other liquids employ able, which may be of different densities, can be choser to affect the bag weight. In some cases, salts may b dissolved in water or other solvent to modify the den sity of the liquid and, as when it is expected that a ba may remain filled overnight in an unheated space i winter, antifreezes, such as ethylene glycol or dissolve salts, may be employed with water to lower its freezin point and prevent freeze-up of the bag. Additionally sometimes the blow responsive properties of the ba may be desirably affected by modifying the liquid tem perature, usually by employing hot or cold water, gen erally within the range of 5° to 60° C., e.g., 15° to 45° C Although the liquid employed may be varied, whether water or some other liquid is used or whether air or another gas is employed as the pressurizing medium the bag will normally be filled to at least ¾ of its final volume with liquid. Usually the liquid content should be from 75 to 99% of the volume, so that at least enough air is present to exert a cushioning effect and so that its pressure will be easily controllable. Also, in some instances it is desirable for the gas to be in communication with an instrument for measuring the number of blows delivered and/or the characteristics of such blows, and the greater the air volume the easier it is to effect such communication. A preferred range of percentages of liquid contents is from 80% to 98% and more preferably the bag will be from 80 to 90% filled with liquid. The remaining bag volume will be filled with gas under a pressure greater than atmospheric. In this description and in the claims where the bag volume is referred to it is considered to be essentially the same as the bladder volume, although it is recognized that the interposition of padding material of an appreciable thickness might make the apparent volume of the bag greater. While it is possible that the gas pressure could be raised to the limit sustainable by the strength of the bag material and construction, normally only a very low pressure is sufficient for the purposes of this invention and such low pressure will be employed to adjust the blow responsive properties of the present athletic bags. While operative pressures up to 4 kg./sq. cm. gauge are easily available, using small hand pumps, generally the pressure employed to regulate satisfactorily the properties of the present athletic bags will be in the range of 0.01 to 0.4 kg./sq. cm., more preferably from 0.02 to 0.2 kg./sq. cm. and most preferably from 0.03 to 0.1 kg./sq. cm. Pressures up to about 0.2 kg./sq. cm. are obtainable by human lung pressure, with pressures up to 0.15 kg./sq. cm. being readily obtainable by most athletes and pressures up to 0.1 kg./sq. cm. being readily obtainable by others. If desired, a pressure gauge may be employed in conjunction with the present invention so that accurate control of pressure is obtainable. Such gauge may be installed adjacent the valve or may be conveniently affixed to the bag. Alternatively, a removable gauge can be used. However, normally it will be sufficient to blow air into the bag, test bag properties, and add more air or let air out, while checking the properties of the bag, until the desired conditions are obtained. To conveniently measure the water content and bag weight the side of the bag may be calibrated to indicate liquid height and weight. In some cases, the bag materials employed may be wholly or partially transparent or translucent or otherwise may be capable of having the water level therein easily determined. Alternatively, the manufacturer may indicate by means of indicia on the bag or a separate gauge, the range of liquid heights to be employed and those preferred for particular practice operations, and may give the equivalent weight of water or other liquid that will result in the proper volume thereof in the bag. If desired the bag may be weighed as the liquid is added.

The materials of construction for the preferred embodiments of the invention will now be described but it should be realized that other materials can also be utilized satisfactorily, providing that they have properties similar to those to be described, or function in comparable manners.

The cover of the invented bag, which together with the bladder and any padding between them constitutes the container portion of this invention, is normally of flexible sheet material and is non-elastomeric. By these terms it is meant that the cover is capable of being changed in shape when the blow is delivered to the athletic bag, but that it does not stretch to any significant extent elastomerically in response to forces applied to it. Thus, it provides a limiting structure or envelope about the relatively expansible bladder, maintaining the container and the bag in desired shape. This is not to say that the cover may not possess some elastomeric properties but they are limited and in effect the cover acts as a confinement so as to shape the container. Although other cover materials, such as canvas, duck or other cloths can also be used, a preferred cover material is made of polyvinyl chloride, polyurethane, fiber reinforced polyester or similar synthetic organic polymeric material and preferably is attractively colored, as desired. Also, such material may be printed with various designs, illustrations, indicia or motifs, and may include a target if desired. While various thicknesses of material may be utilized it is preferred that it be within the range of 0.3 to 1 mm., preferably 0.4 to 0.7 mm., for the synthetic polymeric materials. The textile covers can be of appreciably greater thicknesses. Very preferably, the cover will be a polymeric coated fabric, such as a vinyl coated woven nylon fabric. Among such products the material of choice at present is one sold by Vulcan Coated Fabrics Division of Reeves Brothers, Inc., Rutherfordton, N.C., under the trademark Coverlight ®, and particularly the one identified as 22 Oz. Vinyl. Such material is resistant to abrasion, punctures and tears, is waterproof, non-wicking and is not affected by extreme temperature changes. It is also resistant to fungicidal growth, stiffening from loss of plasticizer, and ultraviolet light, and possesses excellent low temperature flex characteristics. Although the cover material is waterproof, it is not necessary for it to be waterproof and it does not have to be assembled in such a way as to maintain such waterproof characteristics because the bladder, confined by it, is the primary means for containing the liquid and gas under the desired pressure.

The material from which the inner bladder is constructed may be either elastomeric or flexible so long as it is capable of being made fluid-tight. Thus, it is possible that the bladder may be made of the same material as the cover but it will also be expansible to a volume greater than that of the cover, so that the cover can act to resist expansion of the bladder. In some instances, it will be possible to make the bladder and cover out of the material specified for either one, in which cases the expansibility of the container is limited. Nevertheless, it is highly preferable that the bladder be elastomeric, by which designation it is meant that it is of greater elastomeric expansibility than the cover, so that upon filling with liquid and pressurizing with gas it will be expanded, however slightly, to such an extent that its further expansion will be halted by the cover (and any interposed padding or other material). Among the preferred elastomeric products, which usually will be heat sealable, as by dielectric heat sealing, and can be made into bladder form from sheets or cylinders by such sealing (although other sealing methods are also applicable), there may be mentioned natural and synthetic rubbers, e.g., butyl, SBR, nitrile and silicone rubbers, chlorosulfonated polyethylene, neoprene and the polyurethanes, although other equivalent elastomers may be substituted. The thicknesses of the sheet material employed will normally be in the range of 0.2 to 1 mm., preferably 0.3 to 0.6 mm. but greater thicknesses may also be used, especially in those less preferred aspects of the invention wherein the container is of a single sheet of material performing both bladder and cover functions. In some instances, it may be desirable to employ double thicknesses of the bladder material but such is not necessary. Also, in heat sealing the bladder or otherwise closing it, as by clamps, tape, staples or stitching, double or triple seals may be desirable for additional protection. A preferred inner bladder material is a thermoplastic polyurethane sold by Stevens Elastomeric and Plastic Products Inc., Easthampton, Mass., under the tradename Hi-Tuff®. Such product is an ether based polyurethane but ester based polyurethanes are also useful. Most of the preferred polyurethanes are of a Durometer reading in the 70 to 95A range (ASTM test D2240); tensile strength in the range of 300 to 500 kg./sq. cm. (ASTM test D412); elongation of 400 to 700% (ASTM test D412) and modulus, at 300%, of 350 to 1,400 kg. (ASTM test D412). Of the described polyurethane thermoplastics, in sheetform, a material of choice at present is MP-1880. This type of material can also be utilized in film form, sandwiched about a fabric scrim or as film laminate. Still, in whatever form it is used it is very important that the polyurethane will stay sufficiently elastic so that it can expand satisfactorily against the bag cover when "filled" with liquid and pressurized with gas. The properties of the bladder material are similar to those previously described for the preferred cover material: excellent toughness, abrasion resistance, tear strength, flex life, low temperature flexibility, oil and gasoline resistance and aging properties. The preferred materials lend themselves to being vacuum formed and blow molded, in addition to being dielectrically sealable and solvent or heat bonded.

Between the cover and bladder and padding preferably employed is normally a polyethylene foam, such as one with a thickness in the range of 3 mm. to 2 cm., preferably 0.5 to 1.5 cm., e.g., about 1.2 cm. Other resilient synthetic organic polymeric foams may be utilized such as those of polypropylene, polystyrene, polyvinyl chloride, and polyurethane, and laminates of these may also be useful but usually a polyethylene foam, such as one of the density of about 0.02 to 0.1 g./cu. cm., will be used. Preferably the foam will be of the closed cell type but in some cases the cells may be partially broken or, when the polymeric material is sufficiently strong, yet resilient, open cell foams can be used. The main desired characteristic of such foams is resiliency, so that they can absorb and modify the characteristics of the blow administered to the athletic bag and return to initial shape. Also, they may protect the thin bladder against being damaged, as by a boxer's ring.

The valve illustrated and preferably employed in accordance with this invention is a polyethylene push-pull type of valve suitable for frictional or sealing joining to tubing or other bag parts. A preferred embodiment of such valve is sold under the identification Roberts ®320-TE tube end and drainage value and is described in U.S. Pat. No. 2,859,932. Such valve is manufactured by Halkey-Roberts Corporation, Paramus, N.J. The valve is approximately 4 cm. long in open position and 3.3 cm. long in closed position. The valve may be conveniently adapted so as to receive throw-away tube sections, to facilitate more sanitary mouth inflation of the bag by different athletes. Also, portions of the valve (the mouthpiece) may similarly be replaceable. Water, as well as air, may be added or discharged through the valve with little frictional loss, due to the seating design. If desired, the valve may be removed before addition of liquid (water), with a suitable connection being made directly to a hose entering the container, and the valve may similarly be removed to drain the container of the water. However, such is not necessary and when the valves are permanently installed on the container, water, as well as air, may be be quickly added or discharged.

The various hoses that are employed will normally be suitably sized, e.g., from 0.5 to 2 cm. in diameter, preferably about 1.2 cm., and may be joined to other parts by couplings, press fits, clamps, heat sealing, adhesives or other suitable means. Of the materials that may be used to make satisfactorily flexible hoses, the natural and synthetic rubbers and synthetic organic polymers, such as polyethylene, polyvinyl chloride, polytetrafluoroethylene and polyurethane are useful but the preferred material is polyvinyl chloride.

Other items used in the assembly of the bag may be conventional, e.g., support and restraining straps, sewing thread, chains, swivels and such, as used in the making of the previous athletic bags.

Although the description of materials given is to assist the reader to more fully understand the construction of a preferred embodiment of this invention it will be clear that various other materials and means of assembly may be substituted for them.

The invented bag is prepared for use by the method previously mentioned. Usually, it is taken to near a source of water and the source, preferably a faucet, is connected to the bag, preferably by a flexible hose and suitable connections, so that water is added to the bladder, preferably through the open valve. The water is filled to 75 to 99% of the bladder capacity and then the bag is pressurized by mouth to from 0.01 to 0.4 kg./sq. cm. No venting opening in the bag is normally needed to allow the escape of air during filling with water but one can be provided if desirable. The bag may then be hung and is ready for use.

A preferred embodiment of the invention has been described but modifications thereof and the employment of substitutes equivalents are also within the invention. For example, separate means for adding gas and liquid to the container may be employed. The materials for the cover and the bladder can be plastic coated fabrics coated on one or both sides and the elastomer can be a pure, reinforced or laminated material. The bladder may be blow molded or otherwise molded, instead of being formed from sheeting or tubing. The bladder and cover, instead of being cylindrical, may be of other shapes and the padding employed may be of different characteristics so as to result in different extents of penetration thereof during a blow, different resiliences and different feels, in simulation of those of different parts of the human body being struck. The bladder may be of other designs so as to position the liquid and gas as desired. For example, a portion of the bladder, such as along its central axis, can be made so that it is filled with pressurizing air, separated from contact with water, which surrounds it in a different bladder section. Similarly, the air in the bag can be restricted to a bottom portion thereof, instead of the top. Also, gas may be added to the bladder or removed therefrom by piercing of the bladder wall to effect communication with its interior, followed by sealing off the opening. A folded container may be fastened to a lower portion, preferably the bottom, of the bag, ready for unfolding and for covering the bag, just in case it develops any leaks (which have not occurred in actual use). This prevents water damage while the bag is being emptied and repaired. The bag may rest on the floor or be cradled in a lower support, instead of being suspended from an upper support, and it may be weighted and shaped to return to a substantially vertical position after being struck. Other variations of the invention, the article and the method for production thereof, which have been described herein, may also be employed, and the scope of the invention is limited only by the claims.

What is claimed is:

1. A method for preparing for use an athletic bag of controllable blow responsive characteristics, suitable for being struck by a part of the body of an athlete during practice and for controllably absorbing the force of such blow, said bag including a container for holding fluid under pressure, an opening in said container and a push-pull valve for communicating with such opening and selectively permitting or preventing movement of fluid through it, which container includes a flexible substantially non-elastomeric cylindrical outer cover and an elastomeric fluid-tight inner bladder of essentially the same size and shape as the cover, capable of holding liquid and gas under pressure, which comprises adding liquid to the interior of said bladder through said valve to fill said bladder to 75–99% of its volume, and raising the pressure in the bladder to from 0.01 to 0.4 kg./sq. cm. gauge by blowing air through said valve into the bladder, and closing the valve, with the bladder, under such pressure, being restrained by the cover against expansion and exerting a controllable pressure on said cover.

2. A method according to claim 1 wherein the liquid is water, the athletic bag is of cylindrical shape and includes cylindrically shaped padding material between the cover and the bladder, which is form retaining in such position so that upon filling the inner bladder with water through the valve the cylindrically shaped padding material holds the cover and bladder in position so that they are shaped into a cylinder by the addition of water to the bladder, the valve includes a mouthpiece, and the pressure in the bladder is raised to from 0.01 to 0.4 kg./sq. cm. gauge by blowing air through said mouthpiece and through said valve into said bladder.

3. A method according to claim 2 wherein the push-pull valve is communicated with the bladder opening by a tubing which is sealed to said bladder about the opening, the mouthpiece portion of the valve includes a cylindrical portion adaptable for fastening to other tubing through which air or water is addable to the bladder and is removable therefrom, the opening in the container is at the top thereof, the container hangs from an overhead support in swivelable relationship therewith, and liquid is added to the interior of said bladder through said valve and said tubings.

4. A method according to claim 3 wherein the athletic bag is a vertically cylindrical punching bag, the cover is of a polyvinyl chloride-coated woven nylon, the bladder is of a polyurethane sheet material, the intervening padding is of a closed cell polyethylene foam, the water is added to the interior of said bladder through said valve to fill said bladder 80–98% of the volume of the bag and air is blown into said bladder through said valve to raise the pressure in the bladder to from 0.02 to 0.2 kg./sq. cm. gauge.

* * * * *